United States Patent [19]

Egerer

[11] 4,406,038

[45] Sep. 27, 1983

[54] STRETCH HEAD

[75] Inventor: Josef Egerer, Schwabach, Fed. Rep. of Germany

[73] Assignee: Staedtler & Uhl, Schwabach, Fed. Rep. of Germany

[21] Appl. No.: 286,442

[22] Filed: Jul. 24, 1981

[30] Foreign Application Priority Data

Jul. 26, 1980 [DE] Fed. Rep. of Germany ..... 3028376

[51] Int. Cl.[3] ..... D01G 19/10

[52] U.S. Cl. ..... 19/129 R

[58] Field of Search ..... 19/129 R

[56] References Cited

U.S. PATENT DOCUMENTS

| | | | |
|---|---|---|---|
| 2,913,774 | 11/1959 | MacKinnon | 19/129 R |
| 3,984,897 | 10/1976 | Takao | 19/129 R |
| 4,169,301 | 10/1979 | Kaiser | 19/129 R |

*Primary Examiner*—Louis Rimrodt

*Attorney, Agent, or Firm*—Jordan and Hamburg

[57] ABSTRACT

A stretch head for a stretching mechanism includes a plurality of needle rods which move along a generally planar working path and a return path. Linear motor means are operable to move the needle rods along the planar working path along material to be warped and along the return path, and screw means move the needle rods between the two paths.

9 Claims, 3 Drawing Figures

STRETCH HEAD

BACKGROUND OF THE INVENTION

This invention relates to a stretch head for a stretching mechanism with a multiplicity of revolving needle rods which in the working position move approximately in the same plane.

These types of stretch heads, which are also called intersectings, serve to warp or twist wool fleece and similar materials and, as a rule, comprise an upper and a lower needle field with a multiplicity of needle rods which move through the material to be warped or twisted. The needle rods, which are also designated Gill or intersecting rods, comprise rows of steel needles assembled at a distance from each other.

Finally, it has also been known to have the needle rods return in the longitudinal direction through the material, above the working field, with the aid of a screw element, wherein the ends of the needles catch into the threads of the screw element, and to lift the needle rods at the end of the working area by means of cams affixed of the shafts which run synchronously with the longitudinal drive and knock the needle rods back to the return plane. In this known arrangement, although an upright exiting of the needles from the material to be warped or twisted may be ensured so that the occurrence of suspended material may be prevented, the use of the screw element and the upstriking of the needle combs results in the operation of such machines which produce considerable noise and mechanical stress of the needle rods.

SUMMARY OF THE INVENTION

The present invention has as an object to prevent the disadvantages of such known prior art devices and to provide a stretch head which ensures a quiet, rapid and low-maintenance operation with relatively low manufacturing costs.

This object is achieved when using a stretch head of the aforementioned type, in that linear motors can be employed for driving the needle rods in the longitudinal direction through the material to be stretched and/or the return of the needle rods in a longitudinal direction.

Such electro-magnetic linear motors of corresponding capacities for the transport of metallic parts are available in a finished form on the market. They are highly adequate for the longitudinal drive of needle rods, wherein they have the advantage of working without any noise, that they can be selected to strictly correspond to the requirements of each individual case and that they can be easily controlled electronically. Moreover, the needle rods, as contrasted to a chain formation, are less mechanically stressed and, therefore, last longer.

According to the invention it is of special advantage to provide on both ends of the working area, that is perpendicular to the working plane, pairs of screw elements provided with threaded parts which engage recesses in the needle rods for lifting and lowering the needle rods from and into the working area. The lifting and lowering of the needle rods with the aid of revolving screw elements, in contradistinction to known devices in which the needle rods are knocked up through cams, has considerable advantages in that the noise can be kept at a substantially lower level, which in view of official regulations may be of special significance.

Moreover, by applying the procedure according to the present invention, the needles will wear less.

It has been found to be especially advantageous to use linear motors for the operation in a longitudinal direction and screw elements for lifting and lowering the needle rods. The two types of horizontal and vertical movements supplement each other very well, wherein the whole arrangement can be operated with a low level of noise and at a very high working speed.

In another embodiment of the invention, the needle rods are provided with exchangeable engaging parts in the contact area of the screw elements. These engaging parts may be affixed in inclined form corresponding to the pitch of the screw thread. It is preferred to use engaging pieces of an abrasion-resistant artificial material. These parts are subject to wear and, therefore, can be exchanged at low cost, while at the same time the use of artificial material lowers the noise at the areas of engagement of the screw elements and abrasion of the latter is reduced.

Preferably, the needle rods are guided in their longitudinal direction in different planes. This ensures that the needle rods even at the arising of tilting tendency produced by the magnetic field are always kept in a position perpendicular to the working plane. The guiding of the needle rods may, for example, be effected in such a way that the needle rods are provided with vertical pins at a distance from each other that protrude outwardly and which engage in corresponding longitudinal grooves that run parallel to the working plane.

Finally, it has been found to be especially advantageous that the lifting and lowering speed be slightly faster than the linear output speed of the linear motors. Since the linear motors sometimes do not always deliver a homogeneous driving motion, it is ensured that the needle rods are always taken off at the end of the working range in a reliable manner.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantageous thereof will be best understood from the following description of specific embodiment when read in connection with the accompanying drawings.

DESCRIPTION OF THE PREFERRED EMBODIMENTS

Figure 1:
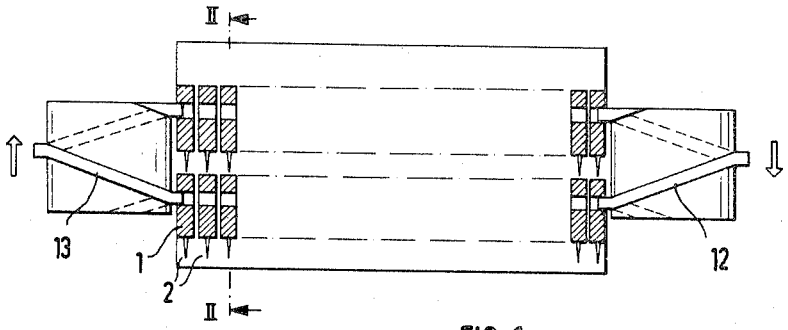
FIG. 1 is a longitudinal sectional view through the upper part of a stretch head according to one embodiment of the invention.
Figure 2:
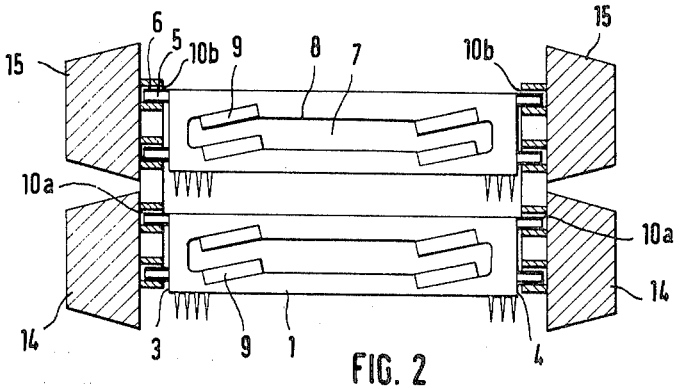
FIG. 2 is a cross-sectional view taken along the line II—II in FIG. 1.
Figure 3:
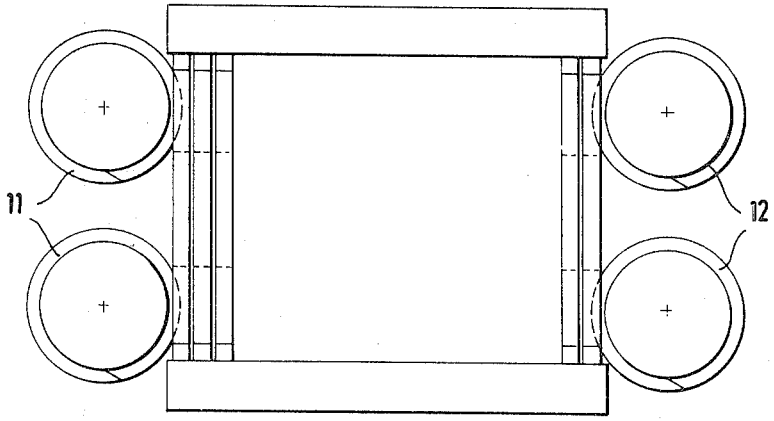
FIG. 3 is a schematic top view of the stretch head of the invention.

The drawings show an upper stretch head with an upper needle field. Each needle field is formed of a multiplicity of needle rods 1 lying closely next to each other.

Each needle rod 1 carries a row of needles 2 assembled next to each other which may, for instance, be cast into a cross-sectional U-shaped groove. The upper part of each needle rod 1 has a basic rectangular form. On each narrow side 3,4 of each upper part of the needle rods 1, viewed in an operational position, there are provided pins 5 assembled vertically over each other and facing outwardly. These pins are surrounded by cases 6 made of sturdy, heat-resistant teflon. The inner area of the rectangular upper side of the needle rods 1 is formed as a recess 7. At the left and right ends of the upper edge 8 of recess 7, there are provided engageable elements 9 of an abrasion-resistant artificial material, wherein the lower sides of the engageable elements 9 are somewhat inclined relative to the horizontal working plane.

The pins 5 of the needle rods 1 run in horizontal guide grooves 10 which are parallel to each other. The two guide grooves 10*a* for the needle rods 1 cause the needle rods which are assembled tightly next to each other, and which enter in engagement with them, to assume a position facing the working plane, while the pairs of guide grooves 10*b* provided on both sides of the needle rods 1, above the guide grooves 10*a*, receive the returning needles 1. The needle rods 1 which are guided in grooves 10*a* form the upper needle field. Correspondingly, a lower needle field may be constructed symmetrically to the working plane.

At each of the two ends of the needle fields formed by the needle rods 1, there are provided, at each end, two screw means 11, 12, assembled perpendicularly to the working plane. Thread 13 of the screws 11, 12 engage into recess 7 of the needle rods 1 in the range of the lower side of the contact pieces 9 whose inclinations correspond to the slopes of the screw threads 13.

On both sides of the needle fields formed by the needle rods 1, there are assembled linear motors 14, 15. These linear motors, not shown in detail, are of a known type commonly found on the market. The linear motor 14 causes the needle field that comes into the working range to advance, while linear motor 15 effects the withdrawal of the needle rods.

The whole process of motion in the upper stretch head is as follows. The needle rods 1 on the lower plane shown in FIG. 1, which follow closely one after the other, are moved by the linear motor 14 in the direction fo the arrow, wherein needles 2 of needle rods 1 comb through the material to be processed, for instance a wool fleece which is not shown in the drawing. Here the needles 1 are safely guided in grooves 10*a* secure against tilting. At the end of the working stretch or cycle, the thread 13 of the screws 11 engages into recess 7 of the needle rods, wherein, at this point, the needle rods 1 sit on each of screws 11, over the contact piece 9, and are lifted upwardly through a synchronous rotation of screws 11. In the range of the return plane, e.g. in the guiding grooves 10*b*, the linear motor 15 grips onto the needle rods 1, withdraws them from screws 11, attaches them to the needle field to be returned, and returns them in the direction of the arrow. At the end of the return trip, the screw 12 catches again in the same way into the recess 7 of the needle rods 1 and removes them through an opposite motion, that is downwardly in the range of guide grooves 10*a*.

Since the linear motors 14, 15 suffer but slight reduction of capacity, the pairs of screw elements 11, 12 run with such a velocity that the vertical feed velocity is somewhat larger than the horizontal feed velocity and thus a paralyzation through discontinuity can be prevented.

Depending on the form of execution, it may be advantageous to provide, at the end of the horizontal conveying stretches, key limit switches in order to guide the advance of linear motors 14, 15 respectively the number of revolutions of impulses for the screws 11, 12 through electronic guidance.

Through the use of linear motors 14, 15 for horizontal driving and the screw elements 11, 12 for vertical driving, in combination with the cases 6 and the engaging pieces 9 of artificial material, a very low level of noise is attainable during operation.

It is, of course, within the scope of the present invention, also possible to use for the vertical drive other mechanical arrangements instead of the screw element, or to produce the vertical drive by electro-mechanical means wherein, in the latter case, it would to a large extent be possible to assemble the whole unit without too many mechanical parts.

An example of a material which may be used for the engageable elements 9 is Teflon. An example of a linear motor means which may be used is one of Mannesmann DEMAG, series 019-025-84.

What I claim is:

1. A stretch head for a stretching mechanism comprising a plurality of needle rods each having a plurality of needles, first guide means for guiding said needle rods along a generally planar working path, second guide means for guiding said needle rods along a return path, said working path being generally parallel to and vertically spaced from said return path, linear motor means operable to move said needle rods along said planar working path along material to be warped and along said return path, screw means disposed on the ends of said planar working path and rotatable about axes generally perpendicular to said planar working path, said needle rods having means defining recesses, said screw means having threads which engage said recesses for moving said needle rods vertically between said planar working path and said return path.

2. A stretch head according to claim 1 wherein said linear motor means move said needle rods along longitudinal paths and said screw means raise and lower said needle rods between said planar working path and said return path, whereby the needle rods continuously travel an endless rectangular path.

3. A stretch head according to claim 1 further comprising exchangeable engaging elements on said needle rods at locations of the needle rods engaged by said threades of said screw means.

4. A stretch head according to claim 1 wherein said first and second guide means and said linear motor means guide and move said needle rods step-wise in said planar working path and said return path, said planar working path being spaced from and generally parallel to said return path.

5. A stretch head according to claim 1 wherein the rate of movement of said needle rods by said screw means is greater than the rate of movement of said needle rods by said linear motor means.

6. A stretch head according to claim 1 wherein at least four screw means are provided for moving said needle rods and at least four sets of engageable elements are provided on each needle rod.

7. A stretch head according to claim 1 wherein said needle rods are provided with pairs of pins which are guided in slots in said first and second guide means.

8. A stretch head for a stretching mechanism comprising a plurality of needle rods each having a plurality of needles, first guide means for guiding said needle rods along a generally planar working path, second guide means for guiding said needle rods along a return path, said working path being generally parallel to and vertically spaced from said return path, screw means disposed on the ends of said planar working path and rotatable about axes generally perpendicular to said planar working path, said needle rods having means defining recesses, engaging elements disposed at said recesses, said screw means having threads which engage said engaging elements for moving said needle rods between said planar working path and said return path, said engaging elements being inclined at an acute angle relative to said planar working path corresponding to the pitch of said screw means, said engaging elements being replaceable on said needle rods as wear occurs as said screw means engages said engaging elements.

9. A stretch head for a stretching mechanism comprising a plurality of needle rods each having a plurality of needles, first guide means for guiding said needle rods along a generally planar working path, a pair of elongated slots in said first guide means, second guide means for guiding said needle rods along a return path, a pair of elongated slots in said second guide means, said working path being generally parallel to and vertically spaced from said return path, linear motor means operable to move said needle rods along said planar working path along material to be warped and along said return path, each of said needle rods having longitudinal ends, a pair of spaced pins extending longitudinally from each longitudinal end of said needle rods, said spaced pins being accommodated and slidably carried in said pairs of elongated slots in said first and second guide means such that tilting of said needle rods is prevented as said needle rods are moved along said working path and said return path, screw means disposed on the ends of said planar working path and rotatable about axes generally perpendicular to said planar working path, said needle rods having means defining recesses, said screw means having threads which engage said recesses for moving said needle rods between said planar working path and said return path.

* * * * *